US011152201B2

(12) United States Patent
Oshiro et al.

(10) Patent No.: US 11,152,201 B2
(45) Date of Patent: Oct. 19, 2021

(54) TIME-OF-FLIGHT MASS SPECTROMETER

(71) Applicant: SHIMADZU CORPORATION, Kyoto (JP)

(72) Inventors: Tomoyuki Oshiro, Kyoto (JP); Daisuke Okumura, Kyoto (JP); Yuta Miyazaki, Kyoto (JP); Hiroaki Kozawa, Kyoto (JP)

(73) Assignee: SHIMADZU CORPORATION, Kyoto (JP)

( * ) Notice: Subject to any disclaimer, the term of this patent is extended or adjusted under 35 U.S.C. 154(b) by 0 days.

(21) Appl. No.: 17/041,859

(22) PCT Filed: Apr. 26, 2018

(86) PCT No.: PCT/JP2018/017077
§ 371 (c)(1),
(2) Date: Sep. 25, 2020

(87) PCT Pub. No.: WO2019/207737
PCT Pub. Date: Oct. 31, 2019

(65) Prior Publication Data

US 2021/0013019 A1 Jan. 14, 2021

(51) Int. Cl.
*H01J 49/40* (2006.01)
*H01J 49/06* (2006.01)
(Continued)

(52) U.S. Cl.
CPC ..... *H01J 49/40* (2013.01); *H01J 49/025* (2013.01); *H01J 49/06* (2013.01); *H01J 49/446* (2013.01)

(58) Field of Classification Search
CPC ..... H01J 49/40; H01J 49/06; H01J 49/0027; H01J 49/025; H01J 49/446
(Continued)

(56) References Cited

U.S. PATENT DOCUMENTS 6,781,121 B1 * 8/2004 Davis ..... H01J 49/025 250/281
2018/0286647 A1 * 10/2018 Guckenberger ..... H01J 49/025

FOREIGN PATENT DOCUMENTS

JP 2006-118176 A 5/2006
JP 2006-185828 A 7/2006
JP 2011-014481 A 1/2011

OTHER PUBLICATIONS

International Search Report for PCT/JP2018/017077 dated Jul. 24, 2018 [PCT/ISA/210].
(Continued)

*Primary Examiner* — Kiet T Nguyen
(74) *Attorney, Agent, or Firm* — Sughrue Mion, PLLC

(57) ABSTRACT

For an automatic adjustment of a detector voltage, a measurement of a standard sample is performed, in which a reflection voltage generator under the control of an autotuning controller applies, to a reflector, voltages which are different from those applied in a normal measurement and do not cause temporal conversion of ions. Ions having the same m/z simultaneously ejected from an ejector are dispersed in the temporal direction and reach a detector. Therefore, a plurality of low peaks corresponding to individual ions are observed on a profile spectrum. A peak-value data acquirer determines a wave-height value of each peak. A wave-height-value list creator creates a list of wave-height values. A detector voltage determiner searches for a detector voltage at which the median of the wave-height values in the wave-height-value list falls within a reference range.

7 Claims, 4 Drawing Sheets

(51) Int. Cl.
*H01J 49/02* (2006.01)
*H01J 49/44* (2006.01)

(58) Field of Classification Search
USPC ..... 250/287
See application file for complete search history.

(56) References Cited

OTHER PUBLICATIONS

Written Opinion for PCT/JP2018/017077 dated Jul. 24, 2018 [PCT/ISA/237].

* cited by examiner

TIME-OF-FLIGHT MASS SPECTROMETER

CROSS REFERENCE TO RELATED APPLICATIONS

This application is a National Stage of International Application No. PCT/JP2018/017077 filed Apr. 26, 2018.

TECHNICAL FIELD

The present invention relates to a time-of-flight mass spectrometer (which may be hereinafter called the "TOFMS"), and more specifically, to a TOFMS in which a DC-type detector configured to measure an average value or integrated value of an ion current is used as the detector.

BACKGROUND ART

In general, in a mass spectrometer, components in a sample are ionized in an ion source, and the generated ions are introduced into a mass separator, in which the ions are separated from each other according to their mass-to-charge ratios m/z, to be eventually detected with a detector. Commonly known detectors used in mass spectrometers can be roughly divided into a DC-type detector configured to measure an average value or integrated value of an ion current which flows due to the ions which have reached the detector, and a pulse-counting detector configured to count pulse signals which represent individual ions arriving at the detector (for example, see Patent Literature 1). Pulse-counting detectors are advantageous for the measurement of a small number of ions and may be used if the signal intensity originating from the ions is low and the level of chemical noise is also low. However, DC-type detectors are used in commonplace cases.

Detectors used in TOFMSs are required to have high levels of responsivity and sensitivity since the time of flight of an ion must be measured with a high level of accuracy. Therefore, a microchannel plate (which may be hereinafter called the "MCP") is typically used as the DC-type detector (see Patent Literature 2 or other related documents). An MCP has a construction in which a large number of micro-sized secondary electron multiplier tubes are bound together. It can detect a two-dimensionally spread cluster of ions almost simultaneously as well as at high rates.

In a detector which uses a microchannel plate, secondary electron multiplier tube or similar device, the gain of the detector changes with the voltage applied to the detector (this voltage is hereinafter called the "detector voltage") regardless of whether it is a DC-type or pulse-counting detector.

In the case of a pulse-counting detector, a change in the gain of the detector changes the wave-height value of a pulse signal which is produced for an ion incident on the detector. If the gain is too low, pulse signals will not be counted since their wave-height values do not exceed the threshold of the count. Conversely, if the gain is too high, a signal which originates from noise or other factors that are not pulse signals will be incorrectly counted. Therefore, the detector voltage must be appropriately set so as to exactly count the number of ions incident on the detector.

For the adjustment of the detector voltage in a mass spectrometer using a pulse-counting detector, a method described in Patent Literature 3 is used. According to this method, a measurement of a standard sample is repeated while successively varying the detector voltage, to investigate the relationship between the count value of the ions originating from a predetermined component in the standard sample and the detector voltage. In normal cases, the relationship between the detector voltage and the ion count value will be as shown in FIG. 6, in which a region called the "plateau region" appears, where the ion count value is almost unchanged against the change in detector voltage (the region indicated by the dotted line in FIG. 6). The ion count value within this plateau region is considered to be the true value which reflects the number of ions incident on the detector. Therefore, a detector voltage corresponding to the plateau region, e.g. the lowest detector voltage within the plateau region, is selected as the optimum voltage for that situation.

On the other hand, in the case of the DC-type detector, a change in the gain of the detector changes the magnitude of the signal intensity which corresponds to the amount of ions incident on the detector. Therefore, if the gain of the detector is too low, the intensity of the signal corresponding to a low-concentration component of the sample cannot be sufficiently obtained due to the low detection sensitivity. Conversely, if the gain of the detector is too high, the intensity of the signal corresponding to a high-concentration component reaches the saturation level due to the high detection sensitivity, and the dynamic range becomes narrow. To address those problems, it is necessary to estimate the concentration range of the sample subjected to the measurement, and adjust the detector voltage so that the detector gain will be appropriate for the estimated concentration range.

In a TOFMS using a DC-type detector, the adjustment of the detector voltage is normally performed based on the peak-intensity value on a mass spectrum acquired by a measurement of a standard sample at a fixed concentration. If the detector is deteriorated, the peak-intensity value becomes lower even when the same detector voltage is applied. Therefore, an automatic adjustment can be realized by adjusting the detector voltage so that the peak-intensity value is maintained at a constant level. However, unlike the ion count value in the pulse-counting detector, the peak-intensity value does not always reflect the exact number of ions incident on the detector. Therefore, the following problem occurs.

The previously described relationship between the detector voltage and the ion count value in the case of using the pulse-counting detector is barely affected by the condition of the sample subjected to the measurement or the condition of a device other than the detector (e.g. the condition of an ion transport optical system). For example, even if the sample is in poor condition and can produce only a small amount of ions originating from the target component, the shape of the curve representing the relationship between the detector voltage and the ion count value remains almost unchanged, although the absolute value of the ion count decreases. The same also applies in the case of a decrease in the number of ions reaching the detector due to a faulty condition of a device other than the detector. Therefore, an appropriate detector voltage can be determined from the relationship between the detector voltage and the ion count value. If the voltage range corresponding to the plateau region has been extremely high, it is possible to infer that the condition of the detector has been significantly deteriorated.

On the other hand, the peak-intensity value on the mass spectrum acquired with a DC-type detector varies depending on the condition of the sample subjected to the measurement or the condition of a device other than the detector. For example, if the sample is in poor condition and can produce only a small number of ions originating from the target component, the peak-intensity value on the mass spectrum decreases. The same also applies in the case of a decrease in the number of ions reaching the detector due to a bad condition of a device other than the detector. Therefore, when the peak-intensity value on the mass spectrum has decreased and the detector voltage must be increased to maintain a constant peak-intensity value, it is difficult for the user to determine whether the situation has been caused by the detector itself or other factors.

CITATION LIST

Patent Literature

Patent Literature 1: JP 2006-118176 A
Patent Literature 2: JP 2006-185828 A
Patent Literature 3: JP 2011-14481 A

SUMMARY OF INVENTION

Technical Problem

The present invention has been developed to solve the previously described problem. Its primary objective is to provide a time-of-flight mass spectrometer using a DC-type detector in which an appropriate detector voltage can be determined based on the response characteristics of the detector alone, without being affected by the condition of a sample, that of a device other than the detector or other factors.

Solution to Problem

The present invention developed for solving the previously described problem is a time-of-flight mass spectrometer including an ejector configured to impart acceleration energy to ions originating from a sample component to eject the ions into a flight space, a flight-space-forming electrode configured to create, within the flight space, an electric field of a predetermined condition which makes the ions ejected by the ejector fly in the flight space, and a detector configured to detect the ions after the ions' flight in the flight space, the time-of-flight mass spectrometer including:

a) a controller configured to control a voltage applied to an electrode in the ejector and/or a voltage applied to the flight-space-forming electrode, so as to create a non-converging condition under which ions having the same mass-to-charge ratio are not temporally converged, when adjusting a detector voltage for adjusting a gain of the detector; and b) a detector voltage determiner configured to conduct a measurement of a predetermined sample under the non-converging condition and determine an appropriate detector voltage based on one or more of the number, height and area of the peaks observed on each of profile spectra created from detection signals respectively acquired at different detector voltages in the measurement.

In a TOFMS having a normal configuration, the voltages applied to the electrodes are minutely set so that a plurality of ions which have the same mass-to-charge ratio and are almost simultaneously ejected from the ejector will simultaneously reach the detector, i.e. so as to achieve temporal convergence of the ions. By comparison, in the TOFMS according to the present invention, when adjusting the detector voltage, the controller controls, for example, a voltage applied to the flight-space-forming electrode so that the voltage becomes different from the voltage applied in a normal measurement, so as to intentionally create a non-converging condition under which the temporal convergence of the ions is not achieved. Under this condition, ions originating from a predetermined component in the sample, i.e. a plurality of ions having the same mass-to-charge ratio, reach the detector with appropriate temporal differences. Therefore, a profile spectrum created from the detection signals acquired with the detector shows low peaks which are most likely to correspond to the individual ions originating from the predetermined component. Each of those peaks can be considered to be a pulse signal corresponding to an ion which would be acquired with a pulse-counting detector.

A change in detector voltage changes the gain of the detector, which in turn changes the height or area of each peak on the profile spectrum. Furthermore, in the case of performing a peak detection in which any peak having a signal intensity lower than a predetermined threshold on the profile spectrum is considered to be a noise peak, the number of peaks also changes as the signal intensity of the peak waveform changes with the change in detector voltage. Accordingly, the detector voltage determiner determines a detector voltage which yields an appropriate, or sufficient, detection sensitivity as well as a sufficiently wide dynamic range, based on one or more of the number, height and area of the peaks which are most likely to correspond to ions originating from the predetermined component observed on each of the profile spectra respectively acquired at different detector voltages.

As the first mode of the TOFMS according to the present invention, the detector voltage determiner may be configured to determine the appropriate detector voltage by determining a distribution of wave-height values or area values of the peaks observed on the profile spectra respectively acquired at different detector voltages, and locating a detector voltage at which a representative value in the distribution becomes a predetermined value specified beforehand. The "representative" value is, for example, an average value or median in the distribution of the wave-height values or area values of the peaks.

As the second mode of the TOFMS according to the present invention, the detector voltage determiner may include: a centroid converter configured to perform a centroid conversion on the profile spectra respectively acquired at different detector voltages; a peak counter configured to count the number of centroid peaks obtained by the centroid conversion for each profile spectrum; and a voltage determiner configured to determine the appropriate detector voltage from the relationship between the detector voltage and peak count value.

According to this mode, centroid peaks are handled similarly to the pulse signals corresponding to the ions obtained in a pulse-counting detector. Therefore, the voltage determiner can determine an appropriate detector voltage from the relationship between the detector voltage and the peak count value by locating a plateau region in which the peak count value is almost unchanged against the change in detector voltage, and selecting an appropriate voltage from a voltage range corresponding to the plateau region. If the plateau region cannot be clearly located, a technique as disclosed in Patent Literature 3 may be used to determine the detector voltage.

As the third mode of the TOFMS according to the present invention, the detector voltage determiner may include: a centroid converter configured to perform a centroid conversion on the profile spectra respectively acquired at different detector voltages; an intensity value totalizer configured to calculate a total of the intensity values of the centroid peaks obtained by the centroid conversion for each profile spectrum; and a voltage determiner configured to determine an appropriate detector voltage from the relationship between the detector voltage and the total of the peak intensity values.

The intensity of a centroid peak is defined as the peak-top intensity or peak area (or the like) of a peak on a profile spectrum. Therefore, it is possible to omit the centroid conversion and directly use the height or area value of a peak observed on a profile spectrum to perform a processing similar to the third mode of the present invention.

Thus, as the fourth mode of the TOFMS according to the present invention, the detector voltage determiner may include: an intensity value totalizer configured to calculate a total of the height values or area values of the peaks observed on a profile spectrum, for each of the profile spectra acquired at different detector voltages; and a voltage determiner configured to determine an appropriate detector voltage from the relationship between the detector voltage and the total of the peak intensity values.

If the detector voltage is too low, the ions incident on the detector cannot produce a peak with a sufficient height (signal intensity) on the profile spectrum, so that no centroid peak emerges. Increasing the detector voltage makes the peaks on the profile spectrum higher. At a point where the detector voltage reaches or exceeds a certain value, the number of centroid peaks suddenly increases. Accordingly, the voltage determiner may be configured to locate a voltage at which a sudden increase occurs in a total peak-intensity value which is the total of the intensity values of the centroid peaks, or in a total peak-intensity value which is the total of the height values or area values of the peaks on the profile spectrum, and to determine an appropriate detector voltage based on the located voltage.

In any of the first through fourth modes, whether the number of ions incident on the detector is large or small does not affect the determination of the detector voltage. Therefore, an appropriate detector voltage can be determined without being significantly affected by a factor unrelated to the detector, such as the condition of the sample or that of a device other than the detector.

As described earlier, the non-converging state for the ions in the TOFMS can be realized by various methods. For example, in the case of a reflectron TOFMS, the state of convergence can be easily disturbed by controlling the state of the reflection electric field created by the reflector.

Thus, in one mode of the TOMS according to the present invention, the flight-space-forming electrode includes a reflector, and the controller is configured to create the non-converging condition by controlling a voltage applied to the reflector.

If the condition of the detector has been significantly deteriorated, a sufficient level of detection sensitivity cannot be achieved even when the highest permissible detector voltage is applied to the detector. In that case, the detector must be replaced. Accordingly, it is preferable for the TOFMS according to the present invention to further include a notifier configured to notify a user of a situation in which a detector voltage determined by the detector voltage determiner is equal or close to an upper limit of a variable range of the detector voltage.

For example, the notifier may be configured to display an alert along with a display of the automatically determined detector voltage. This allows the user to assuredly recognize that the detector has a short remaining service life, and to promptly take appropriate measures, such as the preparation of a replacement part.

Advantageous Effects of Invention

According to the present invention, a TOFMS using a DC-type detector, such as a microchannel plate, can automatically determine an appropriate detector voltage based on the response characteristics of the detector alone, without being affected by the condition of a sample, that of a device other than the detector, or other factors. Accordingly, a measurement in which a sufficient level of sensitivity and a sufficient dynamic range are ensured can always be carried out. Additionally, some problems with the detector, such as the deterioration of the detector, can be assuredly recognized.

DESCRIPTION OF EMBODIMENTS

An OA-TOFMS as one embodiment of the present invention is hereinafter described with reference to the attached drawings.

Figure 1:
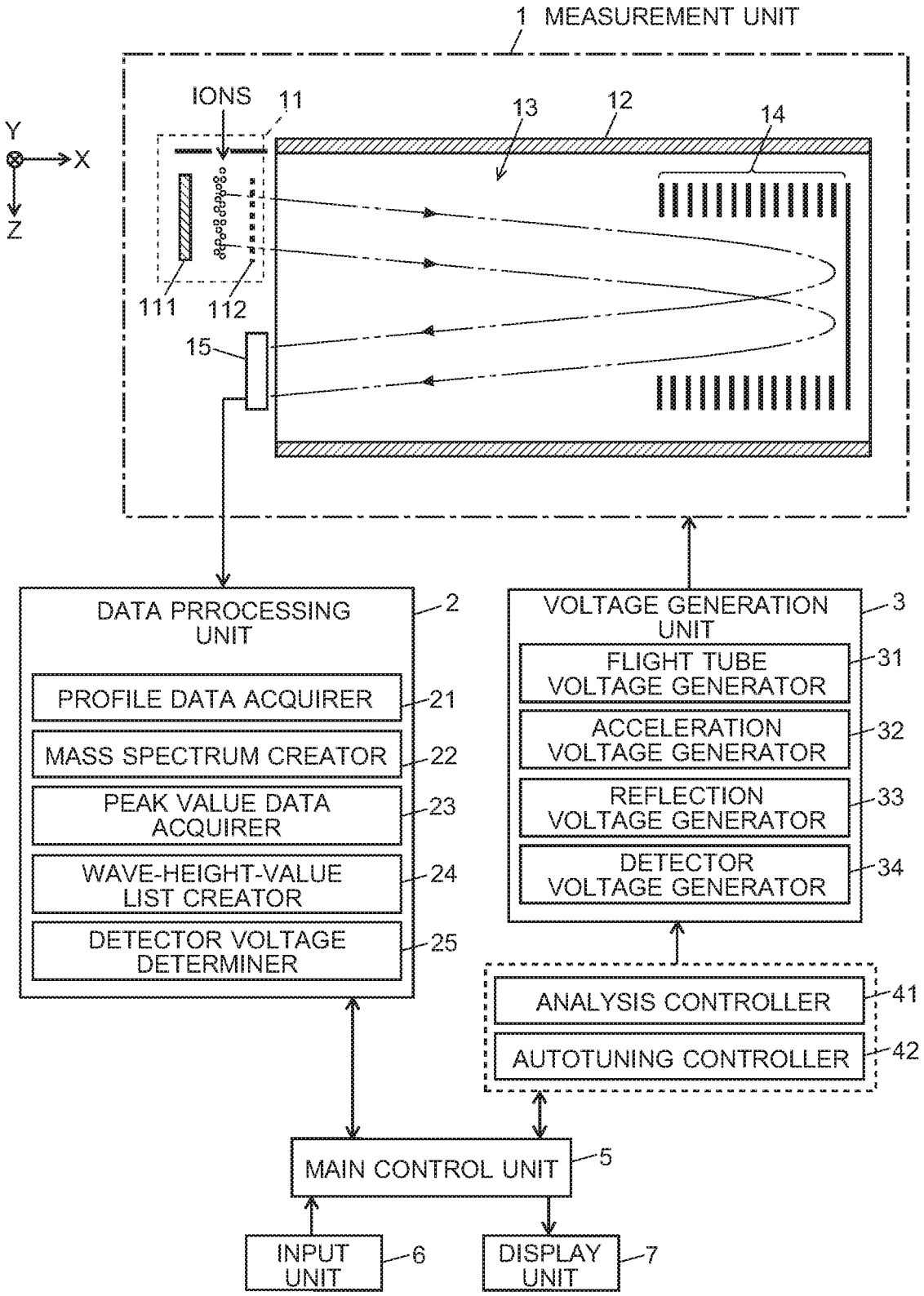
FIG. 1 is a schematic configuration diagram of an orthogonal acceleration TOFMS (which is hereinafter called the "OA-TOFMS") as one embodiment of the present invention.

FIG. 1 is a schematic configuration diagram of the OA-TOFMS according to the present embodiment.

The OA-TOFMS according to the present embodiment includes a measurement unit 1, data processing unit 2, voltage generation unit 3, analysis controller 41, autotuning controller 42, main control unit 5, input unit 6 and display unit 7.

The measurement unit 1 includes: an ejector 11 including a plate-shaped push-out electrode 111 and a grid-shaped extraction electrode 112 facing each other; a flight tube 12 configured to internally form a flight space 13; a reflector 14 including a plurality of ring-shaped reflection electrodes arranged within the flight tube 12; and a detector 15 configured to detect ions. The detector 15 is a microchannel plate (MCP) and can almost simultaneously detect ions which are two-dimensionally spread in a Y-Z plane. For convenience of description, the three axes of X, Y and Z as shown in FIG. 1, which are orthogonal to each other, are defined in the three-dimensional space in which ions move.

The voltage generation unit 3 is configured to apply predetermined voltages to drive each section of the measurement unit 1, including: a flight tube (FT) voltage generator 31 configured to apply a voltage to the flight tube 12; an acceleration voltage generator 32 configured to apply voltages to the push-out electrode 111 and the extraction electrode 112, respectively; a reflection voltage generator 33 configured to apply voltages to the electrodes of the reflector 14, respectively; and a detector voltage generator 34 configured to apply a detector voltage to the detector 15.

The data processing unit 2 is configured to digitize and process detection signals produced by the detector 15, including a profile data acquirer 21, mass spectrum creator 22, peak-value data acquirer 23, wave-height-value list creator 24 and detector voltage determiner as its functional blocks. The main control unit 5 is in charge of the general control of the entire system as well as a user interface.

The main control unit 5, data processing unit 2, analysis controller 41 and autotuning controller 42 may be entirely or partially configured so that their respective functions are realized by executing, on a personal computer, dedicated processing-controlling software previously installed on the same computer.

A normal measurement operation in the OA-TOFMS according to the present embodiment is as follows:

In an ion source (not shown), components (or compounds) in a sample subjected to the measurement are ionized. The ions generated by the ionization or ions generated through dissociation of the ions (these ions are hereinafter collectively called the "ions of sample-component origin") are introduced into the ejector 11 in the Z-axis direction as indicated by an arrow in FIG. 1. Based on a control signal from the analysis controller 41, the acceleration voltage generator 32 applies a predetermined high voltage pulse to either the push-out electrode 111 or extraction electrode 112, or high voltage pulses to both electrodes 111 and 112, at a predetermined timing. The ions of sample-component origin travelling within the space between the push-out electrode 111 and extraction electrode 112 are thereby given acceleration energy in the X-axis direction orthogonal to the Z-axis, to be ejected from the ejector 11 into the flight space 13.

The flight tube 12 is supplied with a predetermined DC voltage from the FT voltage generator 31, while the electrodes of the reflector 14 are respectively supplied with predetermined DC voltages from the reflection voltage generator 33. Consequently, the flight space 13 becomes a field-free space which is not affected by an external electric field, in which a reflection electric field for reflecting ions is created only within the space surrounded by the reflection electrodes forming the reflector 14 arranged in the field-free space. Due to the electric fields created in this manner, ions fly along trajectories as shown in FIG. 1 in which the ions initially fly almost directly from the ejector 11 to the entrance of the reflector 14, and are subsequently reflected within the reflector 14 before they once more fly almost directly to ultimately reach the detector 15. The detector 15 produces detection signals corresponding to the amount of ions which have reached the detector 15. Those signals are sent to the data processing unit 2.

In the data processing unit 2, the profile data acquirer 21, which includes a data storage section, collects profile data, i.e. the raw data obtained by digitizing detection signals continuously acquired by the detector 15 with the passage of time, and stores those data in the data storage section. Based on the profile data collected in the profile data acquirer 21, the mass spectrum creator 22 creates a time-of-flight spectrum showing the relationship between the time of flight and signal intensity, with the point in time of the ejection of the ions from the ejector 11 defined as a time-of-flight value of zero, and converts the time of flight into mass-to-charge ratio based on previously determined mass calibration information, to calculate a mass spectrum. The mass spectrum may be a profile spectrum, which is a continuous waveform, or a centroid spectrum obtained by a centroid conversion of the profile spectrum.

When a mass spectrum for a target sample as described earlier is to be acquired, a set of voltages which have been precisely adjusted (or designed) are respectively applied to the electrodes in the measurement unit 1 so that the same kind of ions which have the same mass-to-charge ratio and are almost simultaneously ejected from the ejector 11 will simultaneously reach the detector 15, i.e. so that the ions will be temporally converged, in order to achieve a high level of mass accuracy and resolving power.

Figure 2:
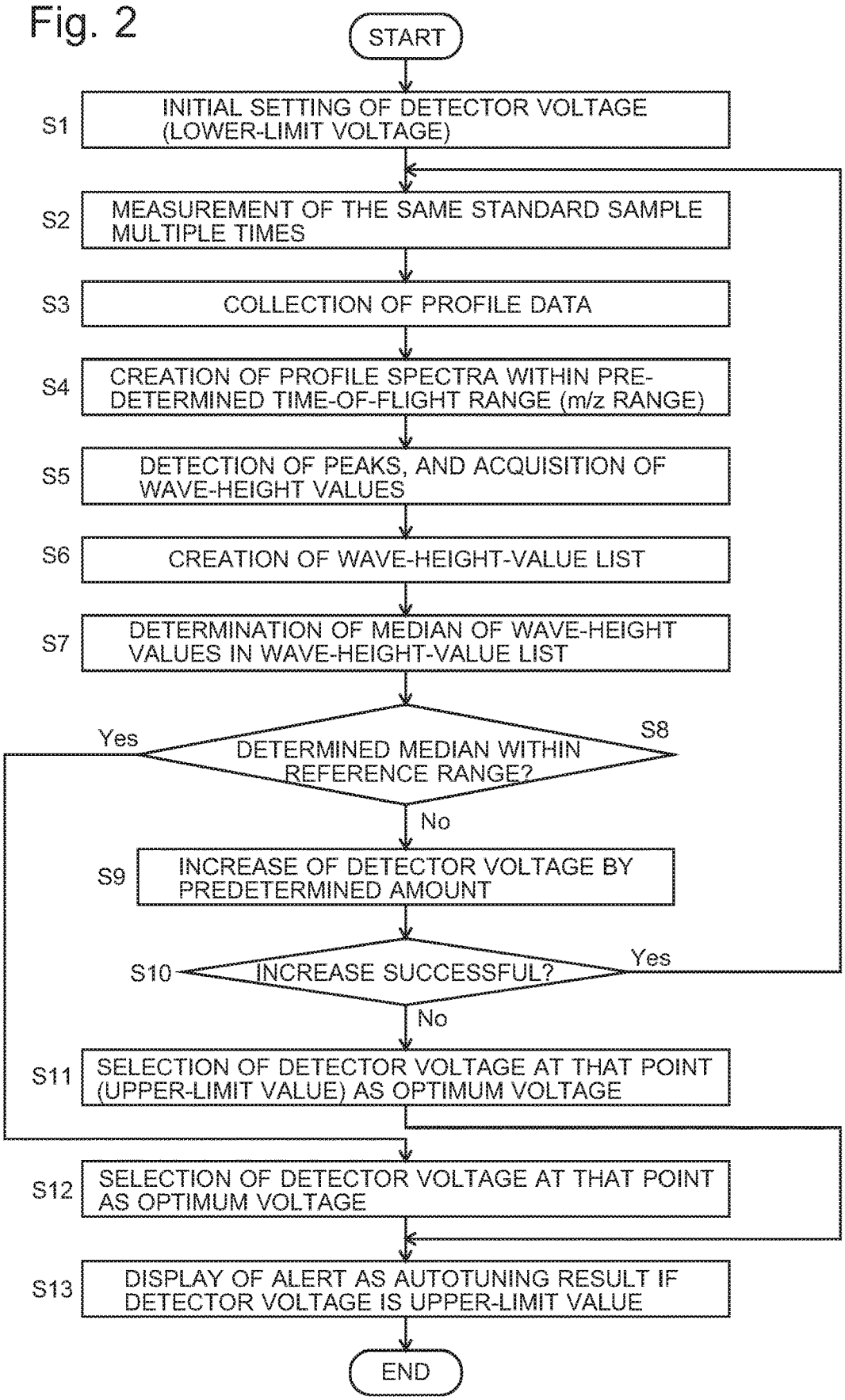
FIG. 2 is a flowchart of the processing and control in an automatic detector-voltage adjustment in the OA-TOFMS according to the present embodiment.

An operation for the automatic adjustment of the detector voltage in the OA-TOFMS according to the present embodiment is hereinafter described with reference to FIGS. 2-4. FIG. 2 is a flowchart of the processing and control in the automatic detector-voltage adjustment. For this automatic adjustment, a standard sample containing a predetermined component is used as the sample to be subjected to the measurement.

For example, a user operating the input unit 6 issues a command to perform the automatic adjustment. Upon receiving this command through the main control unit 5, the autotuning controller 42 controls the reflection voltage generator 33 so that predetermined voltages which are different from those applied in the previously described normal measurement are applied to the reflection electrodes forming the reflector 14. The voltages applied for this operation are intentionally shifted from those of the normal measurement so that the temporal convergence of the same kind of ions having the same mass-to-charge ratio will not occur. Meanwhile, under the control of the autotuning controller 42, the FT voltage generator 31 and acceleration voltage generator 32 apply the identical voltages as used in the normal measurement to the related sections. Furthermore, the detector voltage generator 34 applies the initial voltage, which is the lower-limit voltage of the detector-voltage range, to the detector 15 (Step S1).

Under the control of the autotuning controller 42, the measurement unit 1 repeats the measurement for the same sample a predetermined number of times, e.g. 10 times (Step S2). The profile data acquirer 21 collects the profile data acquired by each measurement (Step S3). The mass spectrum creator 22 creates a profile spectrum which is an accumulation of the profile data acquired through the plurality of measurements. The profile spectrum created in this step does not need to cover the entire time-of-flight range; it only needs to cover a limited time-of-flight range within which the ions originating from the target compound in the standard sample are expected to be observed (Step S4).

As described earlier, when the temporal conversion of the ions having the same mass-to-charge ratio is achieved, ions having the same mass-to-charge ratio which have been almost simultaneously ejected from the ejector 11 almost simultaneously reach the detector 15. In this situation, if a profile spectrum is created from the detection signals produced by the detector 15, the ions having the same mass-to-charge ratio will form a single peak at the same time of flight t1 (or the same mass-to-charge ratio), as shown by diagram (a) in FIG. 3. The height or area of this peak corresponds to the total of the ion current produced by a plurality of ions having the same mass-to-charge ratio. However, it is practically impossible to determine the number of ions from this peak.

On the other hand, when the temporal conversion of the ions having the same mass-to-charge ratio is not achieved, ions having the same mass-to-charge ratio ejected almost simultaneously from the ejector 11 reach the detector 15 in a certainly dispersed form in the temporal direction. In this situation, if a profile spectrum is created from the detection signals produced by the detector 15, the peaks corresponding to a plurality of ions having the same mass-to-charge ratio do not gather at the same time of flight, but will form a plurality of low peaks individually observed at different temporal positions as shown in diagram (b) in FIG. 3. It is certainly possible for two or more ions to simultaneously reach the detector 15 by chance and be observed as a single peak. However, probabilistically, a considerable number of ions having the same mass-to-charge ratio will be observed as individual peaks. That is to say, in an ideal situation, the profile spectrum in diagram (b) in FIG. 3 shows five ions each forming a single peak.

Figure 3:
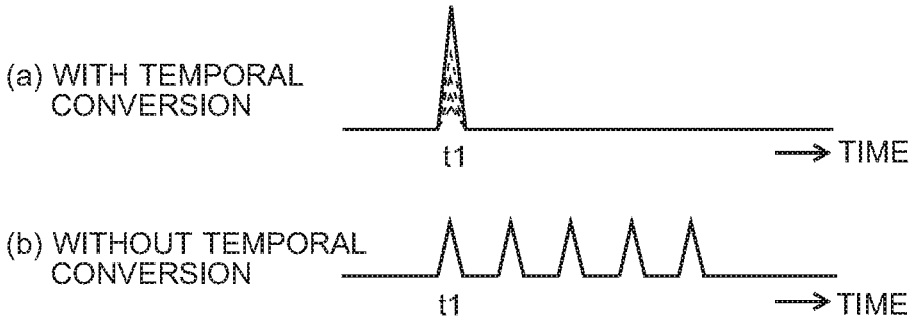
FIG. 3 is a schematic diagram showing (a) a profile spectrum waveform with the temporal convergence of the ions, and (b) a profile spectrum waveform without the temporal convergence.
Figure 4:
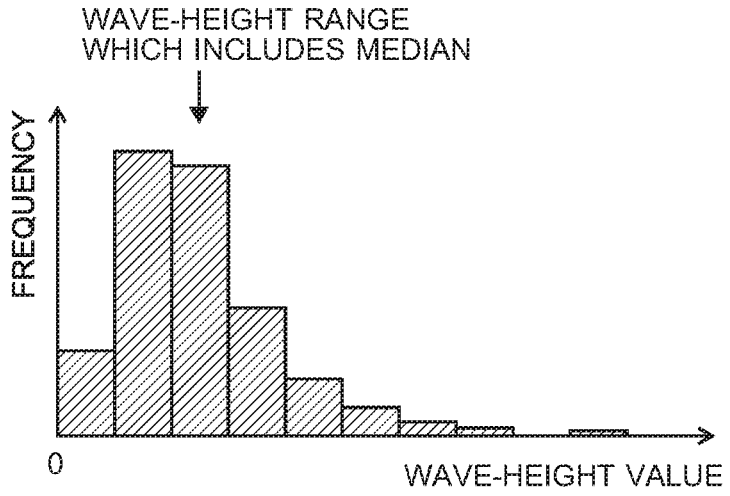
FIG. 4 is a chart showing an example of the wave-height distribution of the peaks determined from profile spectra.
Figure 5:
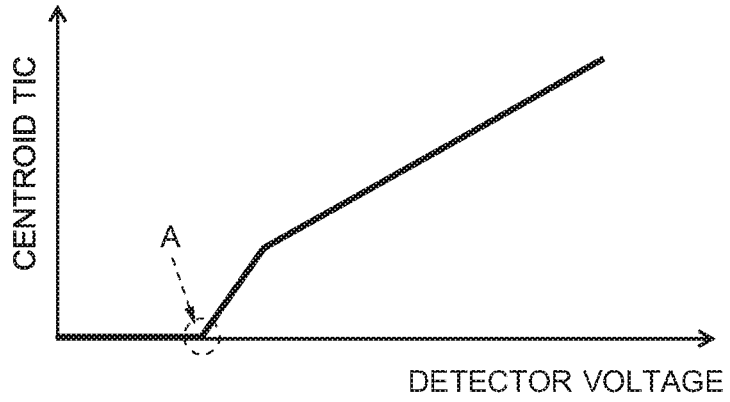
FIG. 5 is a chart showing an example of the relationship between the TIC value of the centroid peaks determined from profile spectra and the detector voltage.

Although all peaks shown in the example of diagram (b) in FIG. 3 have the same wave-height value (i.e. the signal intensity at the peak top), there is practically a considerable amount of variation in the wave-height value of the peak corresponding to a single ion. In some cases, the variation can be ten times or even larger. Accordingly, in the present embodiment, the detector voltage is determined based on profile spectra as follows:

The peak-value data acquirer 23 detects a peak in a profile spectrum according to a predetermined algorithm, and determines the peak value (highest intensity value) of each peak (Step S5). As described earlier, the peak value varies from peak to peak even when each peak corresponds to an individual ion. The wave-height-value list creator 24 creates a list showing the peak value (wave-height value) of each peak (Step S6). Based on the created wave-height-value list, the peak value of each peak may be classified into one of a plurality of wave-height-value ranges. By counting the number of peaks in each wave-height-value range, a histogram showing the wave-height distribution can be created, and the wave-height distribution can be visually presented. FIG. 4 is one example of the wave-height-value histogram.

The detector voltage determiner 25 determines the median of the wave-height values of the peaks in the wave-height-value list (Step S7). An average value may be used in place of the median, or a different kind of representative value may be used, such as a predetermined value (median, upper limit, lower limit or average value) included in the wave-height-value range having the highest frequency in the wave-height-value histogram. Then, whether or not the determined median of the wave-height value is satisfies a previously specified criterion is determined. Specifically, for example, whether or not the median is within a predetermined reference range is determined (Step S8). If the median is within the reference range, the operation proceeds to Step S12, and the detector voltage which is set at that point is selected as the optimum voltage.

On the other hand, if the median of the determined wave-height value is not within the reference range, the detector voltage is increased by a predetermined amount of voltage (Step S9), and whether or not the voltage has been successfully increased is determined (Step S10). If the determination result in Step S10 is "Yes", the operation returns to Step S2 to once more perform the measurement on the standard sample. In other words, if the determination result in Step S8 is "No", it is concluded that the detector voltage is too low, and the measurement on the standard sample is once more performed with the detector voltage increased by a predetermined amount. After new profile data has been acquired, the previously described processing of Steps S4 through S8 is performed.

By such a processing using the profile data obtained through the measurement with the increased detector voltage, the detector voltage is gradually increased in a stepwise manner until the determined median of the wave-height value enters the reference range. After the determined median of the wave-height value has entered the reference range, the operation proceeds from Step S8 to Step S12, and the detector voltage at that point is selected as the optimum voltage and stored in an internal memory.

The increase in the detector voltage increases the gain of the detector 15. However, there is an upper limit of the detector voltage that can be applied to the detector 15. If the condition of the detector 15 is significantly deteriorated, a sufficient level of sensitivity cannot be obtained even when the upper-limit voltage is applied to the detector 15. If the determined median of the wave-height value does not enter the reference range even when the detector voltage has been increased to the upper-limit voltage, the determination result in Step S10 becomes "No". In that case, the detector voltage determiner 25 sets the detector voltage at the upper-limit voltage value (Step S11).

After the detector voltage has been determined in Step S11 or S12, the main control unit 5 displays the autotuning result on the screen of the display unit 7. If the determined detector voltage is the upper limit of the variable range of the voltage, an alert for calling the user's attention is added to the display (Step S13). That is to say, the user viewing the autotuning result on the screen of the display unit 7 is urged to recognize that the detector voltage has reached the upper limit. This allows the user to recognize the deterioration of the currently used detector and consider when to replace the detector.

As described thus far, the OA-TOFMS according to the present embodiment allows the use of a DC-type detector and yet can determine the detector voltage so that a voltage value corresponding to an individual ion will be a predetermined value, as in a pulse-counting detector. Thus, the detector voltage can be determined based on the performance of the detector 15 itself, without being affected by the amount of ions generated in the ion source or that of the ions reaching the detector 15.

The OA-TOFMS according to the previous embodiment determines the detector voltage by the processing of Steps S5 through S12 based on profile spectra acquired under different detector voltages. The method for determining the detector voltage can be replaced by various methods as will be hereinafter described. The following descriptions deal with such modified examples.

[First Modified Example] Processing which Uses Number of Centroid Peaks

A profile spectrum has a continuous waveform in the temporal direction (or in the direction of the mass-to-charge ratio if the time axis is converted into the mass-to-charge-ratio axis). The mass spectrum creator 22 performs a centroid conversion of each peak detected in the profile spectrum to obtain a linear centroid peak. As is commonly known, the mass-to-charge ratio of a centroid peak is the position of the center of gravity of the original peak waveform. The height of the centroid peak is normally the area or height of the original peak waveform, although the height of the centroid peak is not important in the present case. Provided that each peak observed on a profile spectrum corresponds to an individual ion as described earlier, the number of centroid peaks equals the number of ions. Accordingly, each centroid peak is hereby assumed to be a pulse signal corresponding to an individual ion, and the detector voltage is determined in a similar manner to a pulse-counting detector.

Figure 6:
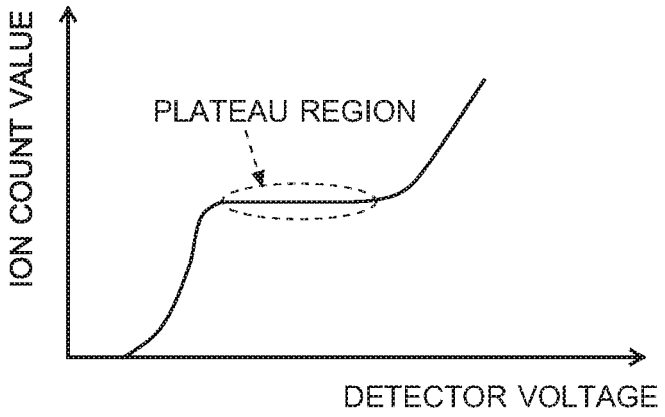
FIG. 6 is a chart showing an example of the relationship between the detector voltage and the ion count value in a mass spectrometer using a pulse-counting detector.

That is to say, if a measurement on a standard sample is repeated with the detector voltage gradually increased, the count value of the centroid peaks based on the result of the measurement increases with the increasing detector voltage while the detector voltage is low. Further increasing the detector voltage leads to a plateau region in which the count value of the centroid peaks is almost unchanged despite the increasing detector voltage. This is the same as the relationship between the detector voltage and the ion count number shown in FIG. 6. The plateau region can be supposed to be a region in which the count value of the centroid peaks truly reflects the number of ions. Accordingly, the detector voltage determiner 25 selects, as an appropriate detector voltage, a detector voltage at which the count value of the centroid peaks increasing with the increasing detector voltage enters the phase in which the count value is unchanged, i.e. a detector voltage within a low-voltage range of the plateau region. An algorithm described in Patent Literature 3 may be used to determine an appropriate detector voltage if it is difficult to locate the plateau region.

[Second Modified Example] Processing which Uses Total of Intensities of Centroid Peaks As opposed to the first modified example which does not use the intensity values of the centroid peaks for the determination of the detector voltage, the second modified example uses the intensity values of the centroid peaks for the determination of the detector voltage.

If the magnitude of the signal intensity corresponding to an individual ion in the detector 15 is equal to or less than a certain value, the peak corresponding to the individual ion will be treated as a noise peak and excluded from the detection even when the peak actually exists. Therefore, no centroid peak will be created for an individual ion if the magnitude of the signal intensity for the ion is not higher than a certain value. Accordingly, if a total ion chromatogram (TIC) is created by totaling the intensities of all centroid peaks within a predetermined time-of-flight range (or mass-to-charge-ratio range) which is supposed to correspond to the components in the standard sample (this TIC is hereinafter called the "centroid TIC"), the centroid TIC will be almost zero at a detector voltage at which the magnitude of the signal intensity for an individual ion is equal to or lower than a certain value. If the detector voltage is gradually increased, the magnitude of the centroid TIC suddenly increases at a detector voltage at which the magnitude of the signal intensity corresponding to the individual ion exceeds a certain value. Accordingly, if a centroid TIC is created by repeating the measurement for a standard sample with the detector voltage gradually increased, the centroid TIC will change as shown in FIG. 4. The detector voltage determiner 25 locates a detector voltage at which the centroid TIC suddenly increases from a level of nearly zero (the position labelled "A" in FIG. 4), and sets, as an appropriate detector voltage, a voltage which is higher than the located detector voltage by a predetermined amount, for example.

[Third Modified Example] Processing which Uses Total of Intensities of Peaks on Profile Spectrum In the second modified example, the centroid TIC is used for the determination of the detector voltage. It is also possible to total the peak-top intensities of the peaks on the profile spectrum before the centroid conversion, in place of the intensities of the centroid peaks, to create a TIC to be used for the determination of the detector voltage.

That is to say, the detector voltage determiner 25 creates a TIC by totaling the peak-top signal intensities of all peaks detected within a predetermined time-of-flight range (or mass-to-charge-ratio range) which is supposed to correspond to the components in the standard sample in the profile spectrum, or the peak-top signal intensities of the peaks whose peak-top signal intensities are equal to or higher than a predetermined threshold. The relationship between this TIC and the detector voltage will also have an overall shape as shown in FIG. 4. Accordingly, this TIC can be used in a similar manner to the second modified example to locate a detector voltage at which the TIC suddenly increases from a level of nearly zero, and set, as an appropriate detector voltage, a voltage which is higher than the located detector voltage by a predetermined amount, for example.

According to any of the first through third modified examples, as in the previous embodiment, the detector voltage can be determined based on the performance of the detector itself, without being affected by the amount of ions generated in the ion source or that of the ions reaching the detector 15.

The previous embodiment and its modified examples may further be appropriately modified. For example, in the previous embodiment, the voltages applied to the reflector 14 are changed from those used for a normal measurement so that the temporal convergence of the ions will not occur. The temporal convergence of the ions can also be disturbed by applying, to the push-out electrode 111 or extraction electrode 112 of the ejector 11, a voltage different from the voltage used in a normal measurement. The voltage applied to the flight tube 12 provides the reference potential in the flight path of the ions. Changing this voltage applied to the flight tube 12 from the voltage used in a normal measurement also disturbs the temporal convergence of the ions. In summary, since the voltages respectively applied to the push-out voltage 111, extraction voltage 112, reflector 14 and other elements in the measurement unit 1 are adjusted relative to the reference potential given by the voltage applied to the flight tube 12, the temporal convergence of the ions can be disturbed by changing any of those voltages. Accordingly, any of those voltages may be changed for the automatic adjustment of the detector voltage.

The previous embodiment is a case in which the present invention is applied to a reflectron OA-TOFMS. The present invention can also be applied in other types of TOFMS, such as an ion trap time-of-flight mass spectrometer in which ions held within a three-dimensional quadrupole ion trap or linear ion trap are accelerated and sent into a flight space, or a type of time-of-flight mass spectrometer in which ions generated from a sample by a MALDI ion source (or the like) are accelerated and sent into a flight space. Furthermore, the present invention is not limited to a reflectron TOFMS but can also be applied in other types of configurations, such as a linear, multi-turn or multi-reflection TOFMS.

The previous embodiment and its modified examples are mere examples of the present invention, and any change, addition or modification appropriately made within the spirit of the present invention will naturally fall within the scope of claims of the present application.

REFERENCE SIGNS LIST

1 . . . Measurement Unit
11 . . . Ejector

111 . . . Push-Out Electrode
112 . . . Extraction Electrode
12 . . . Flight Tube
13 . . . Flight Space
14 . . . Reflector
15 . . . Detector
2 . . . Data Processing Unit
21 . . . Profile Data Acquirer
22 . . . Mass Spectrum Creator
23 . . . Peak-Value Data Acquirer
24 . . . Wave-Height-Value List Creator
25 . . . Detector Voltage Determiner
3 . . . Voltage Generation Unit
31 . . . Flight Tube (FT) Voltage Generator
32 . . . Acceleration Voltage Generator
33 . . . Reflection Voltage Generator
34 . . . Detector Voltage Generator
41 . . . Analysis Controller
42 . . . Autotuning Controller
5 . . . Main Control Unit
6 . . . Input Unit
7 . . . Display Unit

The invention claimed is:

1. A time-of-flight mass spectrometer including an ejector configured to impart acceleration energy to ions originating from a sample component to eject the ions into a flight space, a flight-space-forming electrode configured to create, within the flight space, an electric field of a predetermined condition which makes the ions ejected by the ejector fly in the flight space, and a detector configured to detect the ions after the ions' flight in the flight space, the time-of-flight mass spectrometer comprising:

a) a controller configured to control a voltage applied to an electrode in the ejector and/or a voltage applied to the flight-space-forming electrode, so as to create a non-converging condition under which ions having a same mass-to-charge ratio are not temporally converged, when adjusting a detector voltage for adjusting a gain of the detector; and b) a detector voltage determiner configured to conduct a measurement of a predetermined sample under the non-converging condition and determine an appropriate detector voltage based on one or more of a number, height and area of peaks observed on each of profile spectra created from detection signals respectively acquired at different detector voltages in the measurement.

2. The time-of-flight mass spectrometer according to claim 1, wherein:

the detector voltage determiner is configured to determine the appropriate detector voltage by determining a distribution of wave-height values or area values of the peaks observed on the profile spectra respectively acquired at different detector voltages, and locating a detector voltage at which a representative value in the distribution becomes a predetermined value specified beforehand.

3. The time-of-flight mass spectrometer according to claim 1, wherein:

the detector voltage determiner includes: a centroid converter configured to perform a centroid conversion on the profile spectra respectively acquired at different detector voltages; a peak counter configured to count a number of centroid peaks obtained by the centroid conversion for each profile spectrum; and a voltage determiner configured to determine the appropriate detector voltage from a relationship between the detector voltage and peak count value.

4. The time-of-flight mass spectrometer according to claim 1, wherein:

the detector voltage determiner includes: a centroid converter configured to perform a centroid conversion on the profile spectra respectively acquired at different detector voltages; an intensity value totalizer configured to calculate a total of intensity values of centroid peaks obtained by the centroid conversion for each profile spectrum; and a voltage determiner configured to determine an appropriate detector voltage from a relationship between the detector voltage and the total of the peak intensity values.

5. The time-of-flight mass spectrometer according to claim 1, wherein:

the detector voltage determiner includes: an intensity value totalizer configured to calculate a total of height values or area values of the peaks observed on a profile spectrum, for each of the profile spectra acquired at different detector voltages; and a voltage determiner configured to determine an appropriate detector voltage from a relationship between the detector voltage and the total of the peak intensity values.

6. The time-of-flight mass spectrometer according to claim 1, wherein:

the flight-space-forming electrode includes a reflector, and the controller is configured to create the non-converging condition by controlling a voltage applied to the reflector.

7. The time-of-flight mass spectrometer according to claim 1, further comprising:

a notifier configured to notify a user of a situation in which a detector voltage determined by the detector voltage determiner is equal or close to an upper limit of a variable range of the detector voltage.

* * * * *